US011078769B2

(12) United States Patent
James et al.

(10) Patent No.: US 11,078,769 B2
(45) Date of Patent: Aug. 3, 2021

(54) MULTI STAGE CHEMICAL INJECTION

(71) Applicant: Halliburton Energy Services, Inc., Houston, TX (US)

(72) Inventors: Paul Gregory James, Spring, TX (US); Ibrahim El Mallawany, Spring, TX (US)

( * ) Notice: Subject to any disclaimer, the term of this patent is extended or adjusted under 35 U.S.C. 154(b) by 40 days.

(21) Appl. No.: 15/773,921

(22) PCT Filed: Jun. 21, 2017

(86) PCT No.: PCT/US2017/038503

§ 371 (c)(1),
(2) Date: May 4, 2018

(87) PCT Pub. No.: WO2018/236368

PCT Pub. Date: Dec. 27, 2018

(65) Prior Publication Data

US 2019/0071960 A1 Mar. 7, 2019

(51) Int. Cl.
*E21B 43/25* (2006.01)
*E21B 34/10* (2006.01)
(Continued)

(52) U.S. Cl.
CPC ..... *E21B 43/25* (2013.01); *E21B 33/068* (2013.01); *E21B 34/00* (2013.01); *E21B 34/10* (2013.01); *E21B 43/16* (2013.01); *E21B 37/06* (2013.01)

(58) Field of Classification Search
None
See application file for complete search history.

(56) References Cited

U.S. PATENT DOCUMENTS 4,913,180 A * 4/1990 Anderson, Jr. ..... G05D 11/133 137/2
5,176,164 A 1/1993 Boyle
(Continued)

FOREIGN PATENT DOCUMENTS

WO 2015080968 6/2015

OTHER PUBLICATIONS

"CheckStream Chemical Injection System" Brochure published by Halliburton Energy Services, Inc. in Jan. 2016.
(Continued)

*Primary Examiner* — Matthew Troutman
*Assistant Examiner* — Douglas S Wood
(74) *Attorney, Agent, or Firm* — Scott Richardson; C Tumey Law Group, PLLC

(57) ABSTRACT

Systems and method for injection a chemical into a wellbore. A chemical injection system may comprise a first valve, a chemical line, a pilot line, an injection line, and a backflow prevention valve disposable in the injection line. A production fluid recovery system may comprise a chemical injection system, a first valve, a pilot line, an injection line, a backflow prevention valve, a production tree, a wellhead, and production tubing. A method for actuating a valve in a chemical injection system may comprise pushing a fluid into a chemical line, pressurizing a pilot line to open a first valve, pushing the fluid through the first valve, increasing pressure in the pilot line to open a second valve, pushing the fluid through the second valve, pushing the fluid through a chemical line, and injecting fluid into a wellbore from the chemical line.

20 Claims, 4 Drawing Sheets

(51) Int. Cl.

| | |
|---|---|
| ***E21B 37/06*** | (2006.01) |
| ***E21B 34/06*** | (2006.01) |
| ***E21B 34/16*** | (2006.01) |
| ***E21B 43/16*** | (2006.01) |
| ***E21B 34/00*** | (2006.01) |
| ***E21B 33/068*** | (2006.01) |

(56) References Cited

U.S. PATENT DOCUMENTS

| | | | | |
|---|---|---|---|---|
| 6,659,184 | B1 * | 12/2003 | Tips | F15B 13/01 166/375 |
| 9,695,665 | B2 * | 7/2017 | Older | E21B 33/076 |
| 2006/0043683 | A1 | 3/2006 | Ocalan | |
| 2011/0100645 | A1 * | 5/2011 | Yapici | E21B 23/04 166/375 |
| 2014/0174750 | A1 | 6/2014 | Fripp et al. | |
| 2015/0292301 | A1 | 10/2015 | Minassa et al. | |
| 2016/0273321 | A1 * | 9/2016 | Frosell | E21B 43/12 |
| 2019/0055812 | A1 * | 2/2019 | Halily | E21B 34/066 |

OTHER PUBLICATIONS

International Search Report and Written Opinion for Application No. PCT/US2017/038503 dated Mar. 19, 2018.

* cited by examiner

MULTI STAGE CHEMICAL INJECTION

BACKGROUND

Oil and gas wells formed in the earth often traverse several formation layers or regions of the earth, which may include one or more hydrocarbon reservoirs. Production tubing may be disposed in the well and production fluid from the hydrocarbon reservoirs flows to the surface through the production tubing. During some production operations, it may be beneficial to inject chemicals into the annulus and/or wellbore. Chemicals injected into the annulus and/or wellbore may optimize fluid production and minimize well downtime and expensive intervention.

Chemicals may be injected into the annulus and/or wellbore by a chemical injection system. The chemical injection system may comprise a valve that may be connected to a chemical line. The valve may control the flow of fluids from the chemical line to the annulus and/or wellbore. A pilot line may attach to the valve and hydraulically actuate the valve to open and/or closed position. Both the pilot line and chemical line may be disposed at the surface and run to the chemical injection system disposed downhole in the annulus. The chemical injection system may further be attached to the wellbore.

In many systems, opening and closing of each valve may be controlled and monitored through the movement of hydraulic fluid through a system. Controlling the valve choking position hydraulically through hydraulic control lines and or flow regulators, which control a valve within the chemical injections system, may be limited by the amount of hydraulic pressure that may be able to be applied downhole. Other methods may rely on expensive permanent gauges with complex electronics.

BRIEF DESCRIPTION OF THE DRAWINGS

For a detailed description of the examples of the disclosure, reference will now be made to the accompanying drawings in which.

DETAILED DSCRIPTION

Figure 1:
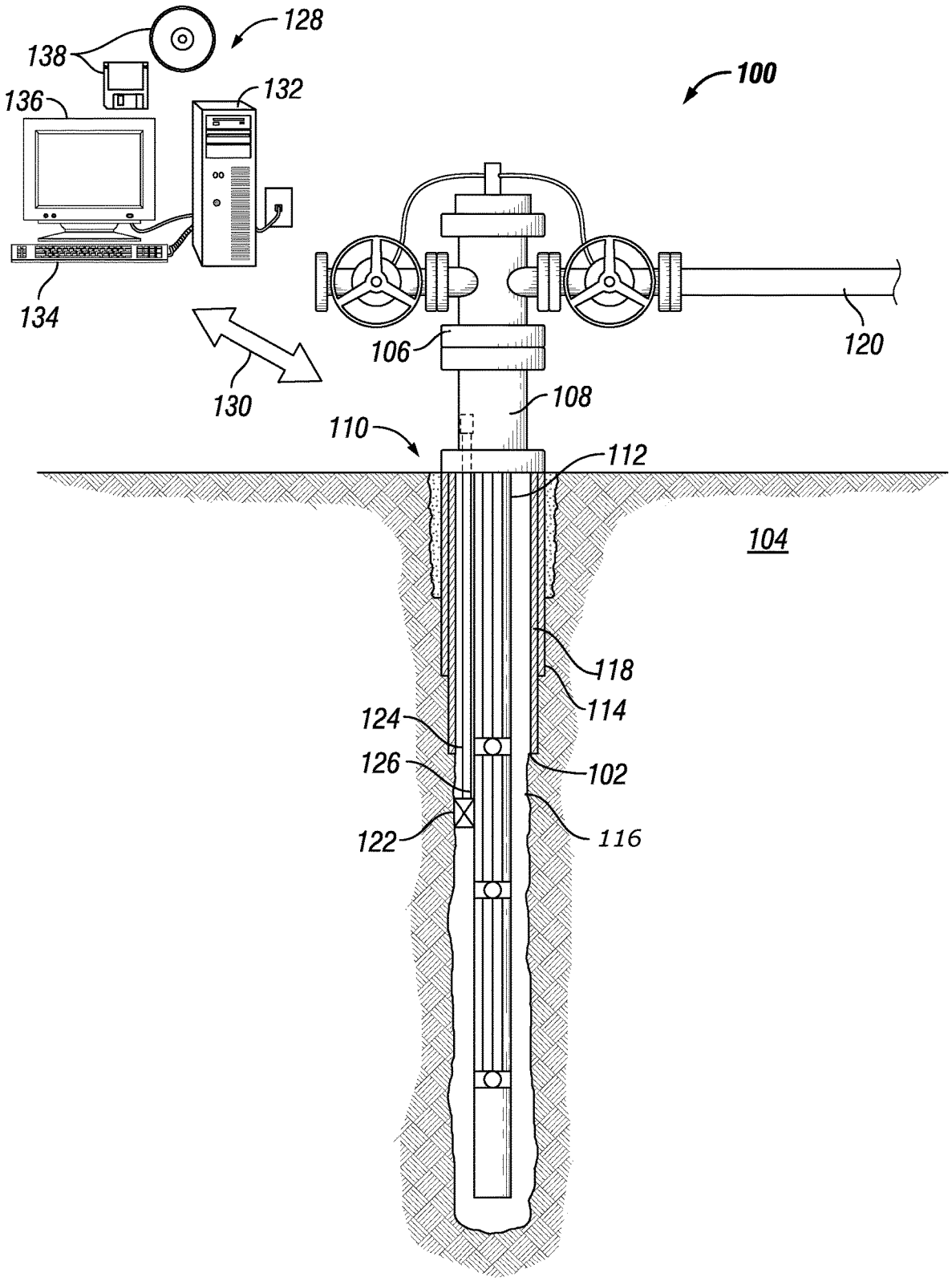
FIG. 1 is a schematic illustration of a production fluid recovery system disposed in a wellbore.

The present disclosure provides systems and methods for inserting fluid into a wellbore at any desirable flow rate. FIG. 1 illustrates a production fluid recovery system 100 disposed in a wellbore 102. Production fluid recovery system 100 may comprise a wellbore 102 formed within a formation 104. Wellbore 102 may be a vertical wellbore as illustrated or it may be a horizontal and/or a directional well. While production fluid recovery system 100 may be illustrated as land-based, it should be understood that the present techniques may also be applicable in offshore applications.

Formation 104 may be made up of several geological layers and include one or more hydrocarbon reservoirs. As illustrated, production fluid recovery system 100 may include a production tree 106 and a wellhead 108 located at a well site 110. A production tubing 112 or a plurality of production tubing 112 may be coupled to production tree 106 and extend from wellhead 108 into wellbore 102, which may traverse formation 104.

In examples, wellbore 102 may be cased with one or more casing segments 114. Casing segments 114 help maintain the structure of wellbore 102 and prevent wellbore 102 from collapsing in on itself. In some examples, a portion of the well may not be cased and may be referred to as "open hole." The space between production tubing 112 and casing segments 114 or wellbore wall 116 may be an annulus 118. Production fluid may enter annulus 118 from formation 104 and then may enter production tubing 112 from annulus 118. Production tubing 112 may carry production fluid uphole to production tree 106. Production fluid may then be delivered to various surface facilities for processing via a surface pipeline 120.

In examples, wellbore 102 may be separated into a plurality of zones and may comprise any number of various tools that may help in the recovery of production fluids from formation 104. As disclosed, production fluid recovery system 100 may comprise chemical injection system 122. Chemical line 126 may provide fluid to be disposed in annulus 118, wellbore 102, and/or production tubing 112. Fluids may be utilized for, scale, asphaltines, emulsions, hydrates, defoaming, paraffin, scavengers, corrosion, demulsifiers, and/or the like. Fluids may flow at any desired rate from the surface through chemical injection system 122 to annulus 118, wellbore 102, and/or production tubing 112. In examples, chemical injection system 122 may connect to wellhead 108 through a pilot line 124 and a chemical line 126. Both of which may be controlled by information handling system 128. In examples, there may be a plurality of pilot lines 124 and/or a plurality of chemical lines 126. In examples, a plurality of pilot lines 124 may control a single chemical line. Communication line 130 may connect information handling system 128 to pilot line 124 and/or chemical line 126. Communication line 130 may be a wired communication and/or wireless communication.

Information handling system 128 may include any instrumentality or aggregate of instrumentalities operable to compute, estimate, classify, process, transmit, receive, retrieve, originate, switch, store, display, manifest, detect, record, reproduce, handle, or utilize any form of information, intelligence, or data for business, scientific, control, or other purposes. For example, information handling system 128 may be a personal computer 132, a network storage device, or any other suitable device and may vary in size, shape, performance, functionality, and price. Information handling system 128 may include random access memory (RAM), one or more processing resources such as a central processing unit (CPU) or hardware or software control logic, ROM, and/or other types of nonvolatile memory. Additional components of information handling system 128 may include one or more disk drives, one or more network ports for communication with external devices as well as various input and output (I/O) devices, such as a keyboard 134, a mouse, and a video display 136. Information handling system 128 may also include one or more buses operable to transmit communications between the various hardware components.

Alternatively, systems and methods of the present disclosure may be implemented, at least in part, with non-transitory computer-readable media. Non-transitory computer-readable media may include any instrumentality or aggregation of instrumentalities that may retain data and/or instructions for a period of time. Non-transitory computer-readable media may include, for example, without limitation, storage media such as a direct access storage device 138 (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

Figure 2:
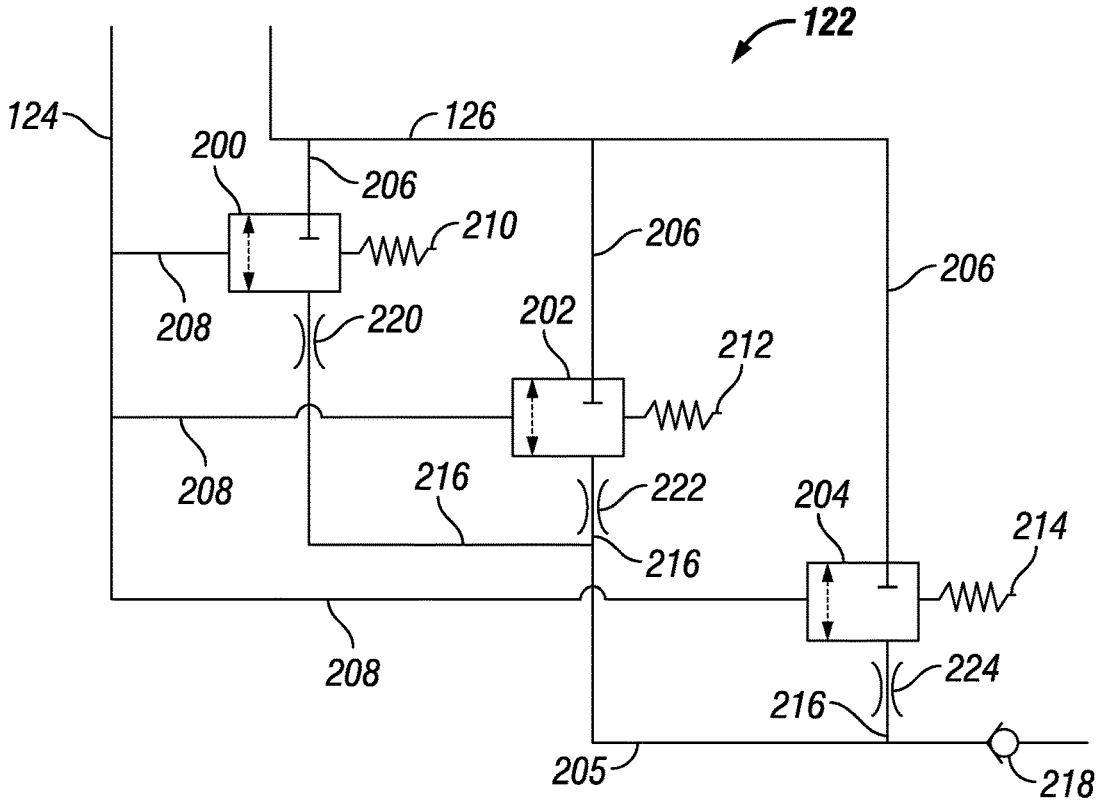
FIG. 2 is a schematic illustration of a chemical injection system with a pilot line.

FIG. 2 illustrates an example of chemical injection system 122. Chemical injection system 122 may comprise a first valve 200, a second valve 202, and/or a third valve 204. First valve 200, second valve 202, and/or third valve 204 may be pilot operated valves, ball valve, and/or a check valve. It should be noted that in additional examples, chemical injection system 122 may comprise at least a first valve 200 and/or a second valve 202. Chemical injection system 122 may comprise any suitable number of valves. As illustrated in FIG. 2, chemical line 126 may be connectable to first valve 200, second valve 202, and/or third valve 204. Chemical branch line 206 may connect chemical line 126 to first valve 200, second valve 202, and/or third valve 204. Fluid from the surface may flow from the surface through chemical line 126, through chemical branch lines 206, and to first valve 200, second valve 202, and/or third valve 204. In examples, information handling system 128 (Referring to FIG. 1) may control the flow of fluid from the surface to first valve 200, second valve 202, and/or third valve 204. Flow from first valve 200, second valve 202, and/or third valve 204 to annulus 118, wellbore 102, and/or production tubing 112 may be controlled by each individual valve.

For example, first valve 200 may open and/or close, which may control the flow of fluid through first valve 200, and ultimately the flow of fluid to annulus 118, wellbore 102, and/or production tubing 112. The opening and closing of first valve 200 may be controllable by pilot line 124. As illustrated in FIG. 1, pilot line 124 may attach to first valve 200 at one end and at a second end be disposed at the surface. Fluid may be disposed within pilot line 124, in which the fluid may be pressurized to open and/or close first valve 200. It should be noted that pilot line 124 may be attached to annulus 118, in which annulus fluid may flow through pilot line 124. Fluid in annulus 118 may be pressurized from the surface. Fluid pressure within annulus 118 may be increase and/or decrease. This may increase the fluid pressure in pilot line 124, which may open and/or close first valve 200. Pilot line 124 may be connectable to first valve 200, second valve 202, and/or third valve 204 through pilot branch lines 208. From the surface, fluid may flow through pilot line 124, through pilot branch lines 208, and to first valve 200, second valve 202, and/or third valve 204. The flow and pressure applied by fluid within pilot line 124 and/or pilot branch lines 208 may be controllable by information handling system 128. Pressure applied by fluid within pilot line 124 and/or pilot branch lines 208 may open and/or close each individual valve within chemical injection system 122. For example, when opened, first valve 200 may be configurable to allow a pre-determined flow rate through first valve 200. Opening and/or closing of first valve 200 may be controllable by a first spring 210. As illustrated in FIG. 2, first spring 210 is a representative illustration, as first spring 210 may be disposed within first valve 200. In examples, first spring 210 may prevent the opening of first valve 200. Pressure applied by fluid in pilot line 124 and pilot branch line 208, through hydraulic pressure, may overcome the force exerted by first spring 210 on first valve 200. In examples, first spring 210 may be configurable to exert any amount of force, spring constant, on first valve 200, for example a non-limiting pressure range for opening first valve 200 may be about 0.5 ksi to about 20 ksi (about 3 MPa to about 138 MPa), about 1 ksi to about 10 ksi (about 7 MPa to about 70 MPa), about 5 ksi to about 15 ksi (about 35 MPa to about 104 MPa), or about 10 ksi to about 15 ksi (about 70 MPa to about 104 MPa). Overcoming first spring 210 through hydraulic pressure in pilot line 124 and/or pilot branch line 208 may allow for fluid to pass from chemical line 126 and/or chemical branch line 206 through first valve 200. In examples, the function and/or operation of first valve 200 and first spring 210 may be substantially similar to the function and/or operation of second valve 202 and second spring 212, as well as third valve 204 and third spring 214

It should be noted that first spring 210, second spring 212, and/or third spring 214 may be configurable and may each comprise different spring constants. This may allow an operator to configure first valve 200, second valve 202, and/or third valve 204 to allow different actuation pressures, which may depend on which valve is open. As pressure may be increased in pilot line 124 and/or pilot branch line 208, first valve 200 may open. Second valve 202 and/or third valve 204 may open as pressure may be further increased within pilot line 124 and pilot branch lines 208. Thus, an operator may control which valves open and the subsequent flow rate of fluid from first valve 200, second valve 202, and/or third valve 204 to injection line 205.

As illustrated in FIG. 2, injection line 205 may be connected to first valve 200, second valve 202, and/or third valve 204 by injection line branches 216. Injection line 205 and/or injection line branches 216 may transport fluid from first valve 200, second valve 202, and/or third valve 204 into annulus 118, wellbore 102, and/or production tubing 112 (Referring to FIG. 1). During operation, injection line 205 may experience pressure from annulus 118, wellbore 102, and/or production tubing 112 from the "U-tube" effect. This effect may be caused from the pressure within annulus 118, wellbore 102, and/or production tubing 112, which may be larger than the pressure in injection line 205. Thus, pressure and fluid from annulus 118, wellbore 102, and production tubing 112 may try to migrate into injection line 205, preventing the flow of fluid into annulus 118, wellbore 102, and/or production tubing 112 from injection line 205. To prevent the "U-tube" effect, backflow prevention valve 218 may be disposed within injection line 205. This may prevent pressure and fluid from moving from annulus 118, wellbore 102, and/or production tubing 112 into injection line 205 and may allow fluid from injection line 205 to flow into annulus 118, wellbore 102, and/or production tubing 112. The flow rate of fluids through injection line 205 may be restricted by first valve 200, second valve 202, and/or third valve 204. Additionally, in embodiments, an operator may further restrict flow from first valve 200, second valve 202, and/or third valve 204 with first flow restrictor 220, second flow restrictor 222, and/or third flow restrictor 224.

As illustrated in FIG. 2, first flow restrictor 220 may be disposed in injection line branch 216 which may be attachable to first valve 200. A flow restrictor, such as first flow restrictor 220, may comprise a single orifice restrictor, a multi orifice restrictor, fluidic device or other flow regulating device. In addition the restrictor orifice(s) may be a tortuous path to maximize orifice diameter to minimize the chance of the restrictors being plugged. The flow of fluid from first valve 200 may be restricted by first flow restrictor 220 as fluid passes through injection line branch 216 to injection line 205. First flow restrictor 220 may be configurable to allow any desired flow rate within injection line 205. In examples, second flow restrictor 222 and third flow restrictor 224 may operate and function as first flow restrictor 220, but may be sized to allow varying flow rates. In examples, first flow restrictor 220, second flow restrictor 222, and third flow restrictor 224 may be disposed within injection line branch 216 attached to first valve 200, second valve 202, and/or third valve 204, respectively. It should be noted that in examples there may not be a flow restrictor disposed in the injection line branch 216 after first valve 200, second valve 202, and/or third valve 204. The final flow rate within injection line 205 may be the sum of fluid flow rates from first flow restrictor 220, second flow restrictor 222, and third flow restrictor 224. A configurable first flow restrictor 220, second flow restrictor 222, and third flow restrictor 224 may allow an operator to configure the flow rate through backflow prevention valve 218 into annulus 118, wellbore 102, and/or production tubing 112.

Figure 3:
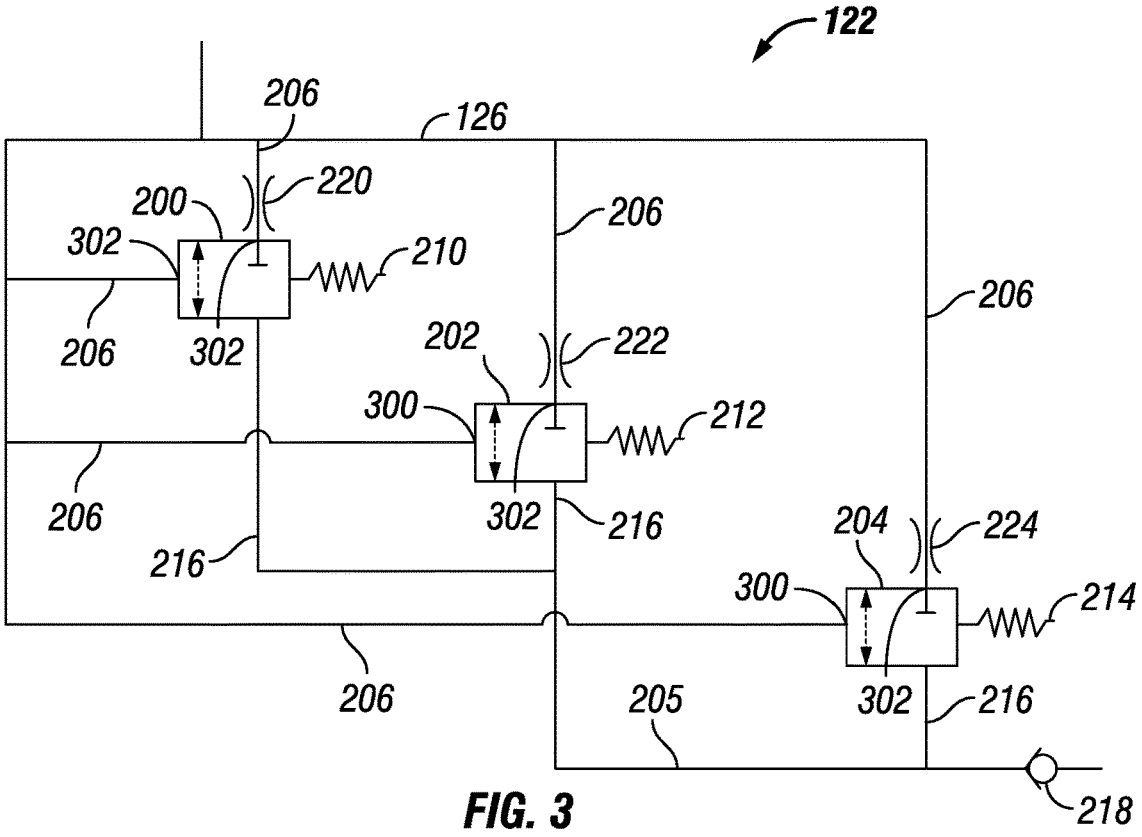
FIG. 3 is a schematic illustration of a chemical injection system without a pilot line.

Referring to FIG. 3, pilot line 124 (Referring to FIG. 2) may not be required to operate examples of chemical injection system 122. In examples, chemical line 126 may operate as pilot line 124 and control the opening of first valve 200, second valve 202, and/or third valve 204. To perform this operation, chemical line branches 206 may be connected to pilot port 300. It should be noted that chemical line branches 206 in FIG. 3 may be regarded as pilot line 124 and/or pilot branch lines 208. Pilot port 300 may be the housing in which chemical line branches 206 attached to first valve 200, second valve 202, and/or third valve 204. It should be noted, that pilot branch lines 208 (Referring to FIG. 2) may attach to pilot port 300, when pilot line 124 (Referring to FIG. 2) may be utilized. Pilot port 300 may allow for pressure to act upon first spring 210 in first valve 200. Thus, information handling system 128 (Referring to FIG. 1) may push fluid from the surface into chemical line 126. Fluid may build up in chemical line 126 and pressurize chemical line 126. A suitable amount of pressure may build up to overcome the spring constant, discussed above, exerted by first spring 210 in first valve 200.

When utilizing chemical line 126 to exert force upon first spring 210, the force may be equal to the force found at chemical line port 302. This may be due to a single line, chemical line 126, through chemical line branches 206, attaching to both pilot port 300 and chemical line port 302. The pressure may remain equal within chemical line 126 and/or chemical line branches 206 because they are all attached to a single source at the surface. Chemical line port 302 may be the housing in which chemical line 126 may attach, which may act as a gateway for fluid from the surface to traverse through chemical line 126, chemical line branch 206, and into first valve 200. The fluid moving through chemical line port 302 may pass through first valve 200 and into injection line branch 216, injection line 205, and into annulus 118, wellbore 102, and/or production tubing 112. If pressure into chemical line port 302 is not regulated, pressure may build up equally within first valve 200 at both pilot port 300 and chemical line port 302. This may produce instability in the first valve 200 leading to rapid opening and closing of first valve 200, leading to damage of the sealing elements. It should be noted that this pressure change may affect any valve in chemical injection system 122. To allow first valve 200 to open, and remain open and stable, first flow restrictor 220 may be disposed in chemical line branch 206 attached to chemical line port 302, which may reduce the pressure at chemical line port 302. The pressure may be reduced by first flow restrictor 220 as discussed above. The function and operation of first valve 200, first spring 210, and first flow restrictor 220 may be substantially similar to second valve 202, second spring 212, and second flow restrictor 222. Further, the function and operation of first valve 200, first spring 210, and first flow restrictor 220 may be substantially similar to third valve 204, third spring 214, and third flow restrictor 224. It should be noted that chemical line 126 and chemical line branches 206 may be connectable to second valve 202 and third valve 204 in substantially the same way as first valve 200, described above.

In examples, there may be a plurality of flow restrictors disposed in chemical line branches 206 before first valve 200, second valve 202, and/or third valve 204. Each flow restrictor may further decrease the fluid flow rate into first valve 200, second valve 202, and/or third valve, respectively. Thus, the flow rate through first valve 200, second valve 202, and/or third valve may be the flow rate within injection line branches 216 and injection line 205. It should be noted that the flow rate of fluid through first valve 200, second valve 202, and/or third valve may be further restricted by additional flow restrictors, which are not illustrated, disposed in injection line branches 216 after first valve 200, second valve 202, and/or third valve 204.

Figure 4:
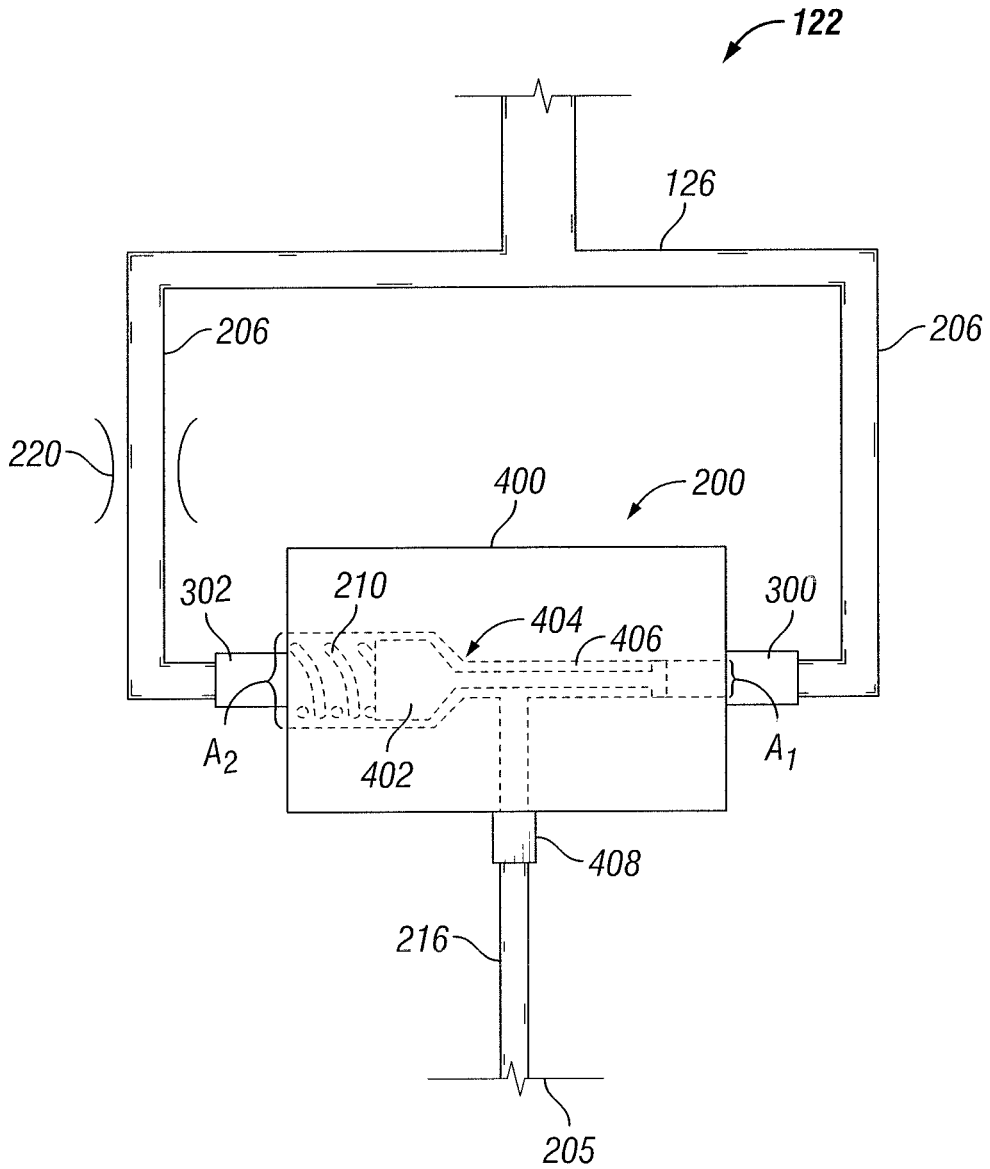
FIG. 4 is a schematic illustration of a valve that may be utilized in the example chemical injection system of FIG. 3.

FIG. 4 illustrates an example of first valve 200 that may be utilized in chemical injection system 122 as illustrated by FIG. 3. First valve 200 may comprise a housing 400, plunger 402, seat 404, channel 406, injection line port 408, first spring 210, chemical line port 302, and pilot port 300. Channel 406 may be disposed within housing 400. In examples, chemical line port 302 and pilot port 300 may attach to channel 406. A first cross sectional area (A1) at pilot port 300 may be equal to or smaller than a second cross sectional area (A2) at chemical line port 302. Disposed within channel 406 may be plunger 402. Plunger 402, when first valve 200 may be closed, may be disposed on seat 404. First spring 210 may exert force on plunger 402 to seal plunger 402 to seat 404, making it water and/or gas tight. Plunger 402 may traverse the length of channel 406 from chemical line port 302 to pilot port 300. Channel 406 may further be connected to injection line port 408, which may allow fluid to flow from the surface and traverse through chemical line 126, chemical line branch 206, through chemical line port 302, through injection line port 408, through injection line branch 216, into injection line 205, and into annulus 118, wellbore 102 and/or production tubing 112. (Referring to FIGS. 1-2). It should be noted that first flow restrictor 220 may be disposed on chemical line 126 before chemical line port 302, but should not interfere with chemical line branch 206 that may be attachable to pilot port 300. This may allow pressure to be reduced at chemical line port 302 and more pressure to be exerted on plunger 402 from pilot port 300 as first valve 200 opens. An increase in pressure at pilot port 300 may overcome force exerted upon plunger 402 by first spring 210, which may move plunger 402 from seat 404. This may allow fluid from chemical line port 302 to pass through first valve 200 and to injection line branch 216. Reduction in pressure in chemical line 126 may allow force exerted on plunger 402 by first spring 210 to overcome the pressure exerted on plunger 402 from fluid at pilot port 300, which may allow plunger 402 to contact seat 404 and form a water tight seal. This may prevent flow of fluid from chemical line port 302 to injection line branch 216. Thus, this may allow first valve 200 to open at a high differential pressure between chemical line 126 and annulus 118, wellbore 102 and/or production tubing 112. Additionally, it may allow first valve 200 to close at a lower differential pressure, which may be based on the area ratio between (A1) and (A2). This may allow an operator to control hysteresis when first valve 200 opens, which may allow a larger flow range by allowing pressure to drop after first valve 200 opens while preventing first valve 200 from closing. It should be noted that the description of the structure and operation of first valve 200 above may be similar to second valve 202, third valve 204, and/or any number of valves disposed in chemical injection system 122 (Referring to FIG. 1).

Figure 5:
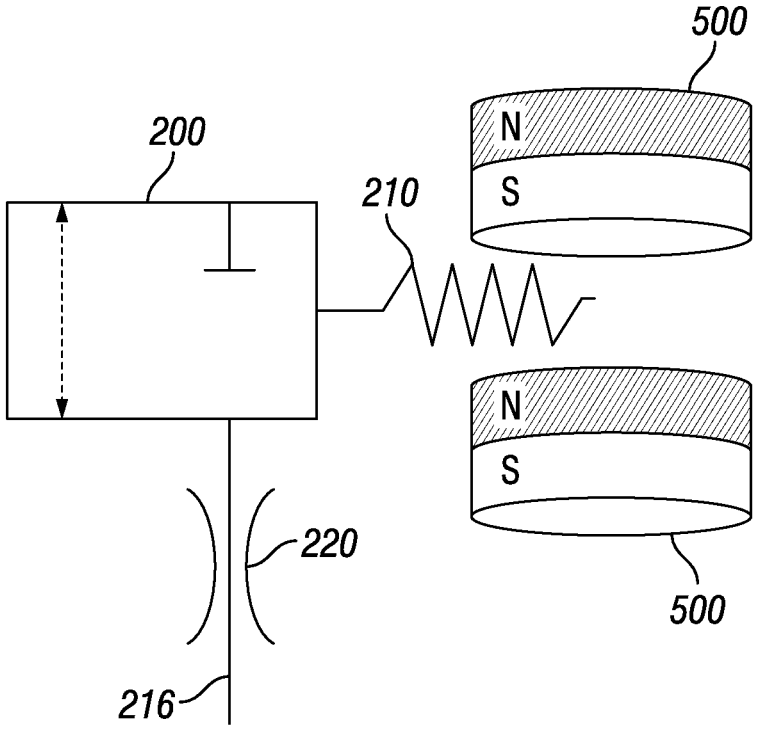
FIG. 5 is a schematic illustration of another valve that may be utilized in the example chemical injection system of FIG. 3.
Figure 6:
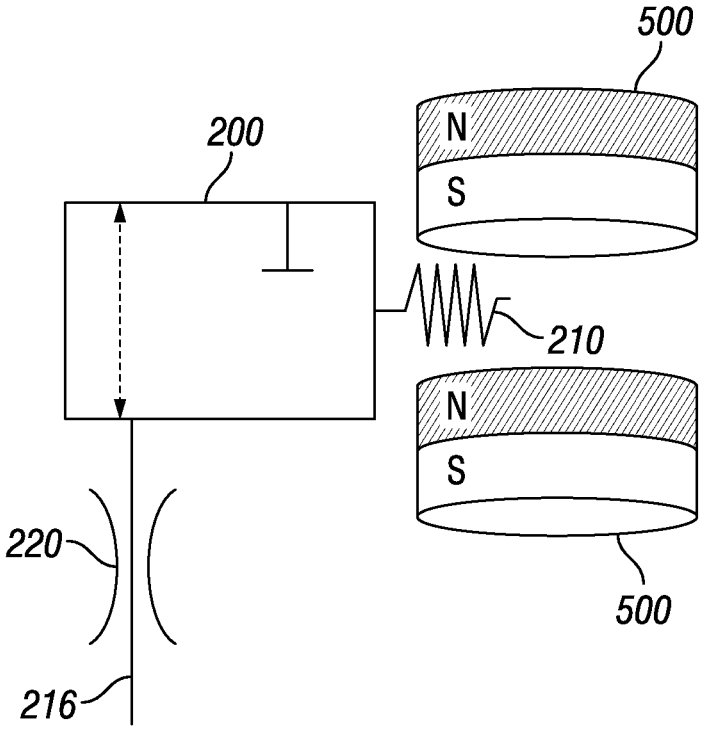
FIG. 6 is a schematic illustration of another valve that may be utilized in the example chemical injection system of FIG. 3.

FIG. 5 further illustrates another example of first valve 200 which may utilize magnets 500 to assist in opening and closing first valve 200. Chemical injection system 122, illustrated in FIG. 3, may encounter pressure fluctuations when utilizing chemical line 126 to open first valve 200 while supplying fluid to injection line 205. For example, when first valve 200 is in an open position there may be a pressure drop as first valve 200 opens, which may cause first valve 200 to close quickly. A pressure drop may be due to the supply of fluid to open first valve 200 and supply of fluid through first valve 200 to injection line 205 coming from a single source, chemical line 126 (Referring to FIG. 3). This may cause intermittent flow through first valve 200. In examples, to prevent intermittent flow through first valve 200, first valve 200 may require higher pressure to open first valve 200 than the pressure required to close first valve 200. This may be achieved by utilizing magnets 500. In examples, magnets 500 may be permanent magnets and/or electromagnets. In examples, magnets 500 may be disposed within first valve 200, second valve 202, and/or third valve 204 at any suitable location. Additionally, magnets 500 may be disposed outside of first valve 200, second valve 202, and/or third valve 204. As illustrated in FIGS. 5, in a closed position, first valve 200 may be disposed away from magnets 500. In this example, magnets 500 may have a weak magnetic force exerted upon first valve 200, which may be weaker than the force exerted upon first valve 200 by first spring 210. As illustrated in FIG. 6, when first valve 200 is in an open position, first valve 200 may be in close proximity to or contact magnets 500, which may allow for a reduced amount of pressure to maintain first valve 200 in an open position. In examples, first valve 200, second valve 202, and/or third valve 204 may move toward magnets 500. Thus, the increase in magnetic force from magnets 500 may assist in holding first valve 200, second valve 202, and/or third valve 204 open. However, the force exerted by first spring 210 must remain higher than the force exerted by magnets 500, for first valve 200 to close when pressure applied to open first valve 200 drops below the pressure to close first valve 200.

Additionally, another example of first valve 200 may be a solenoid operated valve (SOV), not illustrated. An SOV may enhance operational speed and reliability. In examples, SOV's may be controlled through dedicated electrical wires from the surface, or through architecture like Imperium™ or a ROC™ gauge power switching module, or through another, signaling mechanism. An implementation of a passive signaling system may be to place a band-pass filter on the wires from the surface, and supply an AC or pulsating DC signal from the surface. If the signal falls outside of the band-pass filter window, then the power supplied is ignored. If the power is within the filter operating window, the signal may be rectified and smoothed to allow direct operation of the downhole SOV. This signaling method may allow for multiple SOVs to operate on a single line, and allow any combinations of SOV's to be activated.

The systems and methods may include any of the various features of the systems and methods disclosed herein, including one or more of the following statements.

Statement 1: A chemical injection system comprising: a first valve; a chemical line attachable to the first valve and operable to transport a fluid to the first valve; a pilot line attachable to the first valve and operable to open and close the first valve; an injection line attachable to the first valve and operable to transport the fluid; and a backflow prevention valve disposable in the injection line.

Statement 2: The chemical injection system of statement 1, wherein a first flow restrictor is disposable in the injection line and operable to restrict flow of the fluid.

Statement 3: The chemical injection system of statement 2 or statement 1, wherein the first valve comprises a housing, a channel, a plunger, a seat, a spring, an injection line port, a chemical line port, and a pilot port; wherein the chemical line is attachable to the chemical line port and the pilot port; and wherein a first cross sectional area disposed at the chemical line port is equal to or smaller than a second cross sectional area at the pilot port.

Statement 4: The chemical injection system of any preceding statement, wherein the first valve is a solenoid operated valve, and wherein the solenoid operated valve is controllable from surface of a wellbore by an information handling system through electrical wires.

Statement 5: The chemical injection system of any preceding statement, comprising a magnet arranged to apply a magnetic force to the first valve to assist in opening and closing the first valve, wherein the magnet is a permanent magnet or an electromagnet.

Statement 6: The chemical injection system of any preceding statement, comprising a plurality of pilot lines controlling the chemical line.

Statement 7: The chemical injection system of any preceding statement, comprising a plurality of chemical lines controlled by the pilot line.

Statement 8: The chemical injection system of any preceding statement, comprising a plurality of pilot lines controlling a plurality of chemical lines.

Statement 9: The chemical injection system of any preceding statement, wherein the pilot line is connected to an annulus in a wellbore.

Statement 10: A production fluid recovery system comprising: a chemical injection system disposed in a wellbore comprising: a first valve; a chemical line attachable to the first valve and operable to transport a fluid to the first valve; a pilot line attachable to the first valve and operable to open and close the first valve; an injection line attachable to the first valve and operable to transport the fluid; and a backflow prevention valve disposable in the injection line; a production tree; a wellhead; and a production tubing coupled to the production tree and at least partially disposed in the wellbore.

Statement 11: The production fluid recovery system of statement 10, wherein the first valve comprises a housing, a channel, a plunger, a seat, a spring, an injection line port, a chemical line port, and a pilot port.

Statement 12: The production fluid recovery system of statement 10 and statement 11, wherein the chemical line is attachable to the chemical line port and the pilot port; wherein a first flow restrictor is disposed within the chemical line before the chemical line port; and wherein a first cross sectional area disposed at the chemical line port is equal to or smaller than a second cross sectional area at the pilot port.

Statement 13: The production fluid recovery system of statements 10-12, comprising a plurality of pilot lines controlling a single chemical line.

Statement 14: The production fluid recovery system of statements 10-13, comprising a plurality of chemical lines controlled by the pilot line.

Statement 15: The production fluid recovery system of statements 10-14, comprising a plurality of pilot lines controlling a plurality of chemical lines.

Statement 16: The production fluid recovery system of statements 10-15, wherein the first valve is a solenoid operated valve, and wherein the solenoid operated valve is controllable from surface of the wellbore by an information handling system through electrical wires.

Statement 17: The production fluid recovery system of statements 10-16, comprising a magnet arranged to apply a magnetic force to the first valve to assist in opening and closing the first valve, wherein the magnet is a permanent magnet or an electromagnet and wherein the magnet influences the operation of the first valve.

Statement 18: The production fluid recovery system of statements 10-17, comprising a first flow restrictor disposed in the injection line and operable to restrict flow of the fluid.

Statement 19: The production fluid recovery system of statements 10-18, wherein the pilot line is connected to an annulus in the wellbore.

Statement 20: A method for actuating a valve in a chemical injection system comprising: pushing a fluid into a chemical line; pressurizing a pilot line to open a first valve; pushing the fluid through the first valve; increasing pressure in the pilot line to open a second valve; pushing the fluid through the second valve; pushing the fluid through a chemical line; and injecting fluid into a wellbore from the chemical line.

Statement 21: The method of statement 20, comprising restricting flow of a fluid from the first valve with a first flow restrictor and restricting flow of the fluid from the second valve with a second flow restrictor.

Statement 22: The method of statement 20 or statement 21, comprising increasing pressure in the pilot line to open a plurality of valves and restricting the flow from the plurality of valves with a third flow restrictor.

Statement 23: The method of statements 20-22, comprising reducing pressure in the pilot line to close the plurality of valves.

Statement 24: The method of statements 20-23, wherein the chemical line comprises a backflow prevention valve.

Statement 25: The method of statements 20-24, comprising reducing pressure in the pilot line to close the first valve or the second valve.

Statement 26: The method of statements 20-25, wherein the pilot line is a branch from the chemical line.

Statement 27: The method of statements 20-26, wherein the pilot line is attached to an annulus in a wellbore. The preceding description provides various embodiments of the systems and methods of use disclosed herein which may contain different method steps and alternative combinations of components. It should be understood that, although individual embodiments may be discussed herein, the present disclosure covers all combinations of the disclosed embodiments, including, without limitation, the different component combinations, method step combinations, and properties of the system.

It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

Therefore, the present embodiments are well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Although individual embodiments are discussed, the invention covers all combinations of all those embodiments. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present invention.

What is claimed is:

1. A chemical injection system comprising:

a first valve and a second valve;

a chemical line with first and second chemical branch lines connecting the chemical line to the first valve and the second valve, respectively, and operable to transport a fluid from a surface at a well site to the first valve and the second valve;

a pilot line and a plurality of pilot branch lines coupling the pilot line to the first valve and the second valve and operable to open and close the first valve and second valve for controlling flow of the fluid from the chemical line;

an injection line attachable to the first valve and operable to transport the fluid;

a backflow prevention valve disposable in the injection line; and a first flow restrictor disposable in the injection line and operable to restrict flow of the fluid.

2. The chemical injection system of claim 1, wherein the first valve comprises a housing, a channel, a plunger, a seat, a spring, an injection line port, a chemical line port, and a pilot port; wherein the chemical line is attachable to the chemical line port and the pilot port; and wherein a first cross sectional area disposed at the chemical line port is equal to or smaller than a second cross sectional area at the pilot port.

3. The chemical injection system of claim 1, wherein the first valve is a solenoid operated valve, and wherein the solenoid operated valve is controllable from the surface of a well site by an information handling system through electrical wires.

4. The chemical injection system of claim 1, further comprising a magnet arranged to apply a magnetic force to the first valve to assist in holding the first valve in an open position once moved to the open position by operation of the pilot line, wherein the magnet is a permanent magnet or an electromagnet.

5. The chemical injection system of claim 1, comprising a plurality of chemical lines controlled by the pilot line, and/or wherein the pilot line is connected to an annulus in a wellbore.

6. The chemical injection system of claim 1, comprising a plurality of pilot lines controlling a plurality of chemical lines.

7. A production fluid recovery system comprising:

a chemical injection system disposed in a wellbore comprising: a first valve disposed downhole in a wellbore; a chemical line attachable to the first valve and operable to transport a fluid from a surface to the first valve; a pilot line directly attachable to the first valve and operable to flow a pressurized fluid from the surface to the first valve to open and close the first valve, wherein the chemical line and the pilot line are attached to a single source at the surface, so that the pressurized fluid used to open the first valve is from the same single source as the fluid that flows through the open first valve, and wherein the chemical line and pilot line are branches of a single line running from the surface down through an annulus of the wellbore; an injection line attachable to the first valve and operable to transport the fluid; and a first flow restrictor operable to restrict flow of the fluid; a backflow prevention valve disposable in the injection line; and a production tree;

a wellhead; and a production tubing coupled to the production tree and at least partially disposed in the wellbore.

8. The production fluid recovery system of claim 7, wherein the first valve comprises a housing, a channel, a plunger, a seat, a spring, an injection line port, a chemical line port, and a pilot port, and/or wherein the chemical line is attachable to the chemical line port and the pilot port; wherein a first flow restrictor is disposed within the chemical line before the chemical line port; and wherein a first cross sectional area disposed at the chemical line port is equal to or smaller than a second cross sectional area at the pilot port.

9. The production fluid recovery system of claim 7, comprising a plurality of parallel pilot branch lines controlling flow from the chemical line through a plurality of chemical branch lines.

10. The production fluid recovery system of claim 7, comprising a plurality of parallel chemical branch lines controlled by the pilot line.

11. The production fluid recovery system of claim 7, wherein the first valve is a solenoid operated valve, and wherein the solenoid operated valve is controllable from surface of the wellbore by an information handling system through electrical wires.

12. The production fluid recovery system of claim 7, comprising a magnet arranged to apply a stronger magnetic force to the first valve in an open position than in a closed position to assist in holding the first valve in the open position.

13. A chemical injection system comprising:

a first valve;

a chemical line attachable to the first valve and operable to transport a fluid from a surface at a well site to the first valve;

a pilot line directly attachable to the first valve and operable to open and close the first valve;

an injection line attachable to the first valve and operable to transport the fluid;

a backflow prevention valve disposable in the injection line;

a first flow restrictor disposable in the injection line and operable to restrict flow of the fluid;

wherein the chemical line and the pilot line are attached to a single source at the surface, so that the pressurized fluid used to open the first valve is from the same single source as the fluid that flows through the open first valve; and a flow restrictor disposed in the chemical line to reduce pressure from the chemical line to the first valve.

14. The chemical injection system of claim 13, wherein the first valve comprises a housing, a channel, a plunger, a seat, a spring, an injection line port, a chemical line port, and a pilot port; wherein the chemical line is attachable to the chemical line port and the pilot port; and wherein a first cross sectional area disposed at the chemical line port is equal to or smaller than a second cross sectional area at the pilot port.

15. The chemical injection system of claim 13, further comprising a plurality of chemical lines controlled by the pilot line, and/or wherein the pilot line is connected to an annulus in a wellbore.

16. A chemical injection system comprising:

a first valve;

a chemical line attachable to the first valve and operable to transport a fluid from a surface at a well site to the first valve;

a pilot line directly attachable to the first valve and operable to open and close the first valve;

an injection line attachable to the first valve and operable to transport the fluid;

a backflow prevention valve disposable in the injection line;

a first flow restrictor disposable in the injection line and operable to restrict flow of the fluid;

wherein the chemical line and the pilot line are attached to a single source at the surface, so that the pressurized fluid used to open the first valve is from the same single source as the fluid that flows through the open first valve; and wherein the chemical line and pilot line are branches of a single line running from the surface down through an annulus of the wellbore.

17. The chemical injection system of claim 16, wherein the first valve comprises a housing, a channel, a plunger, a seat, a spring, an injection line port, a chemical line port, and a pilot port; wherein the chemical line is attachable to the chemical line port and the pilot port; and wherein a first cross sectional area disposed at the chemical line port is equal to or smaller than a second cross sectional area at the pilot port.

18. A production fluid recovery system comprising:

a chemical injection system disposed in a wellbore comprising: a first valve disposed downhole in a wellbore; a chemical line attachable to the first valve and operable to transport a fluid from a surface to the first valve; a pilot line directly attachable to the first valve and operable to flow a pressurized fluid from the surface to the first valve to open and close the first valve, wherein the chemical line and the pilot line are attached to a single source at the surface, so that the pressurized fluid used to open the first valve is from the same single source as the fluid that flows through the open first valve; an injection line attachable to the first valve and operable to transport the fluid; a first flow restrictor operable to restrict flow of the fluid; and a backflow prevention valve disposable in the injection line; wherein the flow restrictor is disposed in the chemical line to reduce pressure from the chemical line to the first valve a production tree;

a wellhead; and a production tubing coupled to the production tree and at least partially disposed in the wellbore.

19. The chemical injection system of claim 18, wherein the first valve comprises a housing, a channel, a plunger, a seat, a spring, an injection line port, a chemical line port, and a pilot port; wherein the chemical line is attachable to the chemical line port and the pilot port; and wherein a first cross sectional area disposed at the chemical line port is equal to or smaller than a second cross sectional area at the pilot port.

20. The chemical injection system of claim 18, comprising a plurality of chemical lines controlled by the pilot line, and/or wherein the pilot line is connected to an annulus in a wellbore.

* * * * *